US011270561B1

(12) United States Patent
Kelsch et al.

(10) Patent No.: US 11,270,561 B1
(45) Date of Patent: Mar. 8, 2022

(54) ANTI-THEFT DEVICE UTILIZING AN OPTICAL COMMUNICATION CHANNEL TO CONTROL POWER OUTPUT OF AN INDUCTIVE CHARGING COIL

(71) Applicants: Christopher A. Kelsch, Palm Harbor, FL (US); Vanguard Products Group, Inc., Oldsmar, FL (US)

(72) Inventors: Christopher A. Kelsch, Palm Harbor, FL (US); John N. Figh, Jr., Oldsmar, FL (US); William Claude Chazotte, Indian Rocks Beach, FL (US)

(73) Assignee: Vanguard Products Group, Inc., Oldsmar, FL (US)

( * ) Notice: Subject to any disclaimer, the term of this patent is extended or adjusted under 35 U.S.C. 154(b) by 0 days.

(21) Appl. No.: 16/937,115

(22) Filed: Jul. 23, 2020

Related U.S. Application Data

(63) Continuation-in-part of application No. 16/685,649, filed on Nov. 15, 2019, now Pat. No. 10,748,396, which is a continuation of application No. 16/183,009, filed on Nov. 7, 2018, now Pat. No. 10,490,040.

(51) Int. Cl.
*G08B 21/00* (2006.01)
*G08B 13/14* (2006.01)

(52) U.S. Cl.
CPC ..... *G08B 13/1445* (2013.01); *G08B 13/1409* (2013.01); *G08B 13/1481* (2013.01)

(58) Field of Classification Search
CPC ..... G08B 13/1445; G08B 13/1409; G08B 13/1481
USPC ..... 340/568.2
See application file for complete search history.

(56) References Cited

U.S. PATENT DOCUMENTS 5,003,292 A 3/1991 Harding et al.
5,912,619 A 6/1999 Vogt
6,050,622 A 4/2000 Gustafson
(Continued)

FOREIGN PATENT DOCUMENTS

DE 102009049738 A1 4/2011
WO 02073561 A1 9/2002
(Continued)

*Primary Examiner* — Mark S Rushing
(74) *Attorney, Agent, or Firm* — Andriy Lytvyn; Smith & Hopen, P.A.

(57) ABSTRACT

An anti-theft device having an inductive charging coil for wirelessly powering an article of merchandise. A retention member is configured to be attached to the merchandise. A pedestal configured to removably support the retention member. Complementary contacts on the retention member and the pedestal are configured to provide electrical power from the pedestal to the inductive charging coil, when the retention member is at rest on the pedestal. The retention member has an optical transmitter configured to communicate optical signals to an optical sensor. When the article of merchandise requests power increase, the optical transmitter emits a corresponding optical signal, which causes a control unit to increase an output voltage of a power supply supplying power to the electrical contacts of the pedestal. In this manner, an optical communication channel is used to increase the power wirelessly provided from the inductive charging coil to the merchandise.

20 Claims, 7 Drawing Sheets

(56) References Cited

U.S. PATENT DOCUMENTS

| | | | | |
|---|---|---|---|---|
| 6,150,940 | A | 11/2000 | Chapman et al. | |
| 6,799,994 | B2 | 10/2004 | Burke | |
| 6,804,465 | B2 | 10/2004 | Volpi et al. | |
| 6,888,461 | B2 | 5/2005 | Houde | |
| 7,209,038 | B1 | 4/2007 | Deconinck et al. | |
| 7,239,238 | B2 | 7/2007 | Tester et al. | |
| 7,327,276 | B1 | 2/2008 | Deconinck et al. | |
| 7,667,601 | B2 | 2/2010 | Rabinowitz et al. | |
| 8,558,688 | B2 | 10/2013 | Henson et al. | |
| 8,698,617 | B2 | 4/2014 | Henson et al. | |
| 8,698,618 | B2 | 4/2014 | Henson et al. | |
| 9,786,140 | B2 * | 10/2017 | Henson | G08B 25/10 |
| 9,818,274 | B2 | 11/2017 | Fawcett et al. | |
| 2008/0169132 | A1 * | 7/2008 | Ding | G06F 3/03545 178/19.02 |
| 2011/0241870 | A1 | 10/2011 | Irmscher et al. | |
| 2011/0254661 | A1 | 10/2011 | Fawcett et al. | |
| 2011/0309928 | A1 | 12/2011 | Henson et al. | |
| 2011/0309934 | A1 | 12/2011 | Henson et al. | |
| 2012/0047972 | A1 | 3/2012 | Grant et al. | |
| 2012/0099256 | A1 | 4/2012 | Fawcett et al. | |
| 2012/0257890 | A1 | 10/2012 | Aguren | |
| 2012/0268103 | A1 | 10/2012 | Henson et al. | |
| 2014/0111337 | A1 | 4/2014 | Taylor et al. | |
| 2014/0159898 | A1 | 6/2014 | Wheeler et al. | |
| 2015/0048945 | A1 | 2/2015 | Fawcett et al. | |
| 2016/0094074 | A1 * | 3/2016 | Alves | H01F 38/14 320/108 |
| 2016/0351029 | A1 * | 12/2016 | Fawcett | G08B 13/1481 |
| 2017/0032636 | A1 | 2/2017 | Henson et al. | |
| 2017/0373755 | A1 * | 12/2017 | Walton | H04B 10/1143 |
| 2018/0293857 | A1 * | 10/2018 | Berglund | G08B 13/1454 |

FOREIGN PATENT DOCUMENTS

| | | | |
|---|---|---|---|
| WO | 2009103793 | A1 | 8/2009 |
| WO | 2011045058 | A2 | 4/2011 |
| WO | 2012069816 | A1 | 5/2012 |

* cited by examiner

ANTI-THEFT DEVICE UTILIZING AN OPTICAL COMMUNICATION CHANNEL TO CONTROL POWER OUTPUT OF AN INDUCTIVE CHARGING COIL

PRIORITY CLAIM

This non-provisional application is a continuation-in-part of a U.S. Non-Provisional application Ser. No. 16/685,649 filed on Nov. 15, 2019, which is a continuation of and claims priority to a U.S. Non-Provisional patent application Ser. No. 16/183,009 filed on Nov. 7, 2018.

BACKGROUND OF THE INVENTION

1. Field of the Invention

This invention relates to merchandise anti-theft devices. More specifically, it relates to an anti-theft device for monitoring the integrity of a tether cable connection which secures an article of merchandise to a display counter.

2. Brief Description of the Related Art

Retailers often prefer to present their merchandise to consumers in a way that allows the consumers to touch, inspect, and otherwise interact with the products at a display counter. Many merchandise items, especially portable electronic devices, are relatively expensive and, therefore, are under a serious threat of theft. Retailers often face a dilemma pertaining to how to interactively display their merchandise to attract customers and increase sales, while, at the same time, safeguarding the merchandise against theft.

A number of anti-theft devices are known in the art. Some anti-theft solutions involve various types of brackets that secure an electronic gadget to the display counter. Others involve protective sheaths and cases. What is needed, however, is an anti-theft device that discretely monitors the electronic gadget against unauthorized removal from the display counter without interfering with its aesthetic or functional features.

One such solution is disclosed in U.S. Pat. No. 9,818,274 (the '274 Patent). This solution involves a security sensor that couples to an article of merchandise and a tether cable connected to the security sensor. The tether cable provides a mechanical safeguard against unauthorized removal of the article of merchandise from the display counter. To prevent a thief from stealing the article of merchandise by either disconnecting or cutting the tether cable, the '274 Patent discloses a bidirectional optical communication scheme for determining whether the cable has been cut or disconnected. The bidirectional optical communication scheme relies on a first optical transceiver being disposed within the sensor, and a second optical transceiver being disposed within the cable. The first and second optical transceivers communicate optical signals to one another when the tether cable is connected to the sensor. If a thief cuts or disconnects the cable, the bidirectional communication between the optical transceivers ceases, thereby triggering an alarm.

One major flaw of the security system disclosed in the '274 Patent is attributed to the complexity associated with implementing a reliable bidirectional communication. To enable bidirectional communication, there must be a scheme whereby the sensor transceiver energizes its receiver circuit and the cable transceiver energizes its transmitter circuit in a synchronized manner, therefore imposing significant requirements for timing coordination. Missed communications increase the likelihood of false alarms.

Furthermore, because the accuracy of the security system disclosed in the '274 Patent requires two separate transceivers—i.e., two separate sets of optical transmitters and optical receivers—working properly and in unison, the security system becomes unreliable when either one of the two transceivers fails to respond as required by the synchronization scheme.

Another significant flaw of the '274 Patent is that it requires two separate power sources to power its two separate transceivers. The security system disclosed in the '274 Patent requires a battery to energize the transceiver within the sensor. The battery constitutes another possible point of failure for the security system because, in the event that the battery is compromised, or its charge has been depleted, the bidirectional communication between the sensor and the cable will fail. The requirement to have a separate power source for each transceiver also increases the cost of the security system and introduces further complexities to its design. These flaws are inherent in the security systems that utilize active two-way communication between the sensor and the cable.

Thus, what is needed is an improved and simplified anti-theft device for monitoring integrity of a tether cable connection using a single optical transmitter and a single optical receiver.

SUMMARY OF THE INVENTION

A long-felt but heretofore unfulfilled need for an anti-theft security device for monitoring integrity of a tether cable connection using a single optical transmitter and an optical sensor is now met by a new, useful, and non-obvious anti-theft device. The anti-theft device for safeguarding an article of merchandise includes a retention member configured to couple to the article of merchandise. The anti-theft security device further includes a cable configured to be coupled to the retention member. The cable is in an electrical communication with a security interface. The security interface is electrical circuitry that is configured to trigger an alarm responsive to detecting a predetermined event.

An optical transmitter is disposed within the cable. The optical transmitter is energized by an electrical current supplied to the optical transmitter via the cable. When the cable is coupled to the retention member, a chamber is formed at the interface of that coupling. The optical transmitter is configured to emit an optical signal into that chamber. The cable also has an optical sensor in communication with the chamber. The optical sensor is configured to detect a reflected optical signal, wherein the reflected optical signal is an optical reflection of the first optical signal within the chamber.

If the cable is disconnected from the retention member, the chamber becomes compromised, and the optical signal stops being reflected therein. Likewise, if the cable is cut, supply of the electrical current to the optical transmitter ceases, which causes the optical transmitter to deenergize. Either of these events results in the optical sensor not detecting the reflected optical signal. The security interface is configured to trigger an alarm responsive to the optical sensor failing to detect the reflected optical signal, thereby indicating that the cable has been cut or disconnected.

The optical transmitter and the optical sensor disclosed above can both be integrated into a single optical transceiver having optical receiving and transmitting circuits.

The anti-theft device can also include a pedestal configured to support the retention member and the article of merchandise to which it is coupled. The security interface can be housed within the pedestal. The cable is anchored to a non-movable structure either within the pedestal or the display surface.

In an embodiment, the retention member includes a security sensor. The security sensor is equipped with its own optical sensor, which is configured to detect the optical signal emitted by the transmitter disposed within the cable. This embodiment achieves redundancy by enabling both the electrical circuitry within the pedestal and the security sensor within the retention member to independently trigger the alarm when the cable is either cut or disconnected.

In an embodiment, the cable has a male plug and the retention member has a female port configured to accept the male plug. The optical transmitter can be housed within the plug. In an embodiment, the optical transmitter is an infrared emitter, and the optical sensor is a photo-transistor.

DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Figure 1A:
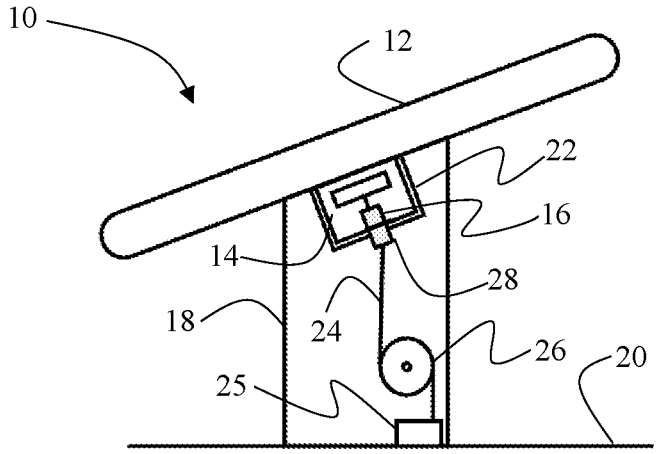
FIG. 1A is a schematic view of an embodiment of the anti-theft device in its at-rest configuration.
Figure 1B:
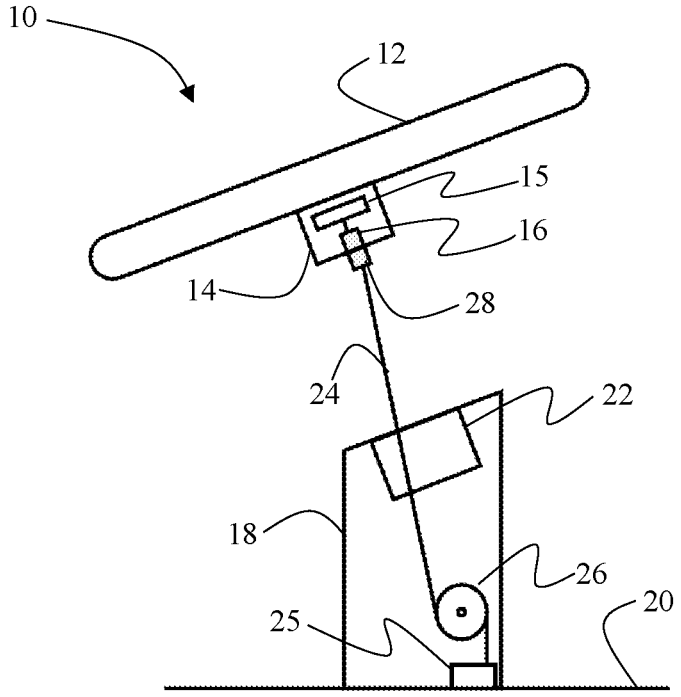
FIG. 1B is a schematic view depicting a configuration of the anti-theft device in which the security sensor and the article of merchandise coupled thereto are lifted from a pedestal.

FIGS. 1A-B depict an anti-theft device 10 configured to secure an article of merchandise 12. A retention member 14 is configured to be coupled to article of merchandise 12. Retention member 14 has a port 16 disposed on a surface of retention member 14 opposite the surface coupled to article of merchandise 12, such that port 16 is not obstructed by article of merchandise 12 when retention member 14 is coupled thereto. Retention member 14 includes a security sensor 15 configured to trigger an alarm responsive to detecting a predefined event. In the security-device industry, when the retention member assembly houses security sensor 15, the retention member assembly is commonly referred to as a "security sensor" or "security puck."

Security device 10 further includes a pedestal 18 attached to a display counter 20. Pedestal 18 has a cavity 22 configured to accept retention member 14. Article of merchandise 12 has a default, at-rest position depicted in FIG. 1A. When a customer wishes to interact with article of merchandise 12, the customer can lift article of merchandise 12 from pedestal 18, as depicted in FIG. 1B. To ensure that customer cannot walk away with article of merchandise 12, security device 10 includes a tether cable 24. A first end of tether cable 24 is anchored to a non-movable structure. In an embodiment, tether cable 24 can be integrated into a cable reel 26. Cable reel 26 can be affixed within pedestal 18 or, alternatively, can be anchored to a top or a bottom surface of display counter 20, or another non-movable structure.

The second end of tether cable 24 has a male plug 28 configured for insertion into port 16 of retention member 14. In an alternative embodiment, retention member 14 has a male plug, while tether cable 24 has a corresponding female port configured to receive that male plug. A person skilled in the art will recognize that the invention disclosed herein can be practiced with various connectors disposed on cable 24 and retention member 14, including male-female, female-male, female-female, and male-male couplings without departing from the principles of the invention. To facilitate clarity of the disclosure, the description provided herein focuses on the embodiment in which retention member 14 is equipped with a female port 16 and tether cable 24 is equipped with a corresponding male plug 28. This configuration is merely exemplary and should not be interpreted in a limiting sense.

Port 16 of retention member 14 and plug 28 of tether cable 24 are structured to facilitate a secure mechanical connection therebetween. A person skilled in the art will appreciate that there are numerous methods of achieving such secure mechanical connection. For example, port 16 and male plug 28 can be structured to screw-threadedly engage one another, such that male plug 28 screws into port 16. In another example, male plug 28 includes a biased tab or clip configured to engage a corresponding groove within port 16—similar to universal ethernet cable connectors. Other means of achieving a secure connection between male plug 28 and port 16—including adhesive, fasteners, magnets, friction connection, etc.—are known in the art and fall within the scope of the invention.

Figure 2:
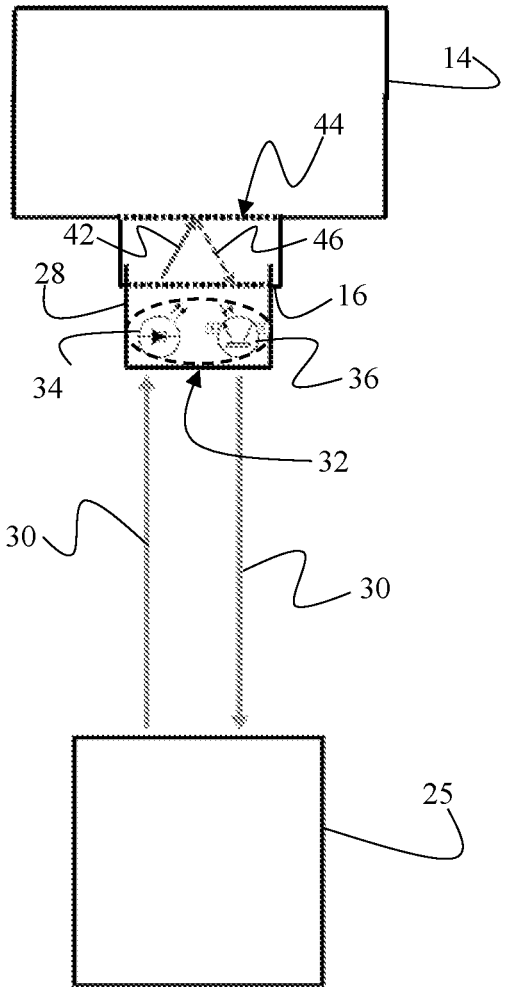
FIG. 2 is a diagram depicting an embodiment of the invention in which the retention member does not have a security sensor and an optical sensor.

To ensure that a thief cannot undetectably disconnect male plug 28 from port 16 or cut tether cable 24 and remove article of merchandise 12 from the store, security device 10 is configured to trigger an alarm when such an event occurs. To accomplish this objective, in an embodiment depicted in FIG. 2, security device 10 has an optical transmitter 34 and optical sensor 36, which are housed within male plug 28 of tether cable 24. In an embodiment, optical transmitter 34 is an infrared (IR) emitter, and optical sensor 36 is a phototransistor configured to output an electric signal responsive to receipt of an optical signal. In an embodiment, optical transmitter 34 and optical sensor 36 are, respectively, transmitting and receiving circuits of an optical transceiver 32.

Optical transmitter 34 and optical sensor 36 are energized by an electric current supplied via electrical conductors 30 disposed within cable 24. Plug 28 and port 16 are structured such that when plug 28 is inserted into port 16, they collectively define a chamber 44 (also referred to as "echo chamber 44"). When transmitter 34 emits optical signal 42 into chamber 44, optical signal 42 is reflected creating a reflected optical signal 46. Reflected optical signal 46 is an optical reflection of optical signal 42 within echo chamber 44. Properties of reflected optical signal 46 may be dependent on dimensions and geometry of the echo chamber 44, the reflectivity coefficient of the interior surfaces of the echo chamber 44, the properties of the emitted signal 42, and other factors.

Optical sensor 36 is configured to detect reflected optical signal 46. When optical sensor 36 detects reflected optical signal 46, a corresponding electrical signal is relayed via electrical conductor 30 within cable 24 back to security interface 25 within pedestal 18. If plug 28 is removed from port 16, echo chamber 44 will become compromised and, thus, optical sensor 36 will stop detecting reflected optical signal 46.

Likewise, if cable 24 is cut, electrical conductor 30 will stop supplying electrical current to transmitter 34, causing transmitter 34 to deenergize and stop emitting optical signal 42. Without optical signal 42, there is no reflected optical signal 46. Thus, optical sensor 36 will stop receiving optical signal 46 when cable 24 is either cut or disconnected from retention member 14. When security interface 25 does not receive an electric signal from optical sensor 36 confirming that reflected optical signal 46 has been successfully detected, security interface 25 triggers an alarm. This embodiment relies solely on the reflected optical signal 46 for monitoring integrity of the connection between plug 28 and cable 24 and integrity of cable 24 itself.

In this embodiment, retention member 14 does not need a power source—i.e., a battery—because retention member 14 can perform its functions without any electronic components. As described above, security device 10 monitors integrity of cable 24 and integrity of its connection to retention member 14 using the following security optical loop: when cable 24 is coupled to retention member 14, optical transmitter 34 emits optical signal 42 into chamber 44, optical signal 42 is reflected within camber 44, and optical sensor 36 detects reflected optical signal 46. No active action is required from retention member 14—its sole function with respect to the security optical loop is providing a surface necessary to complete echo chamber 44. Relative to prior art devices that require a bidirectional optical communication loop (such as the one disclosed in the '274 Patent), security device 10 reduces cost and simplifies operation by eliminating a battery, security sensor 15, and a second transmitter/receiver from retention member 14. For many applications, this simplified embodiment provides a solution that is preferred over the security systems that rely on the bidirectional communication scheme.

Figure 3:
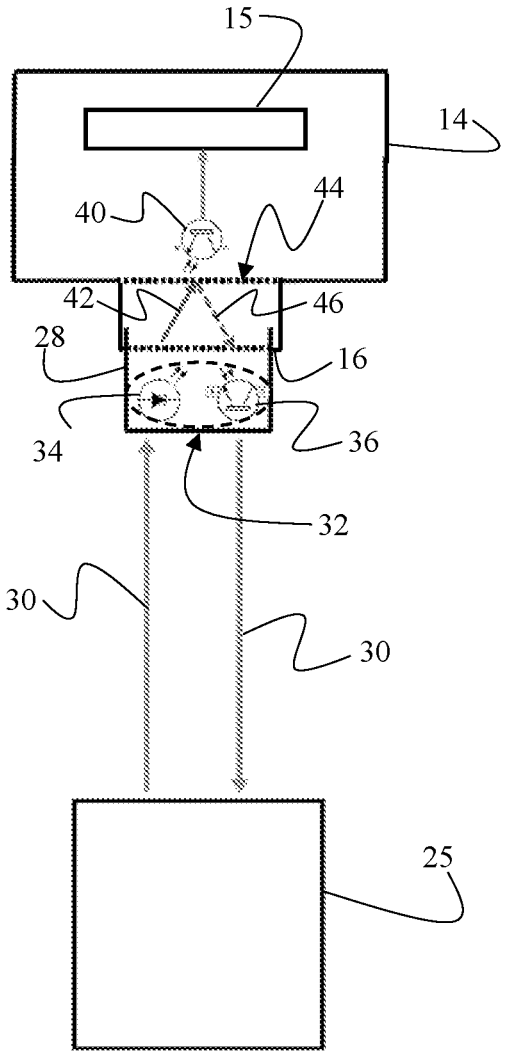
FIG. 3 is a diagram depicting an embodiment of the invention utilizing a security sensor configured to independently monitor integrity of the cable and its connection to the sensor.

In the retail security industry, redundancy is an important consideration. Although the embodiment depicted in FIG. 2 has multiple advantages, it does not provide redundancy because only security interface 25 within pedestal 18 has the capability to trigger an alarm. Inventors of security device 10 have invented a novel and non-obvious solution to enable security device 10 to have redundancy without requiring bidirectional communication between two separate transceivers. In the embodiment depicted in FIG. 3, retention member 14 further includes security sensor 15 capable of independently triggering an alarm. In this embodiment, retention member 14 houses a second optical sensor 40. When male plug 28 is positioned within female port 16, optical transmitter 34 engages in a unidirectional optical communication with optical sensor 40, such that optical sensor 40 is configured to detect an optical signal 42 emitted by transmitter 34. If optical signal 42 is not detected by optical sensor 40 at a designated time, or if the frequency or strength of optical signal 42 changes in excess of allowable tolerance, security sensor 15 triggers an alarm. The unilateral communication between transmitter 34 and optical sensor 40 enables security sensor 15 within retention member 14 to independently monitor integrity of the connection between male plug 28 and port 16 and integrity of cable 24.

Two conditions must be satisfied for optical sensor 40 to detect optical signal 42. First, plug 28 must be positioned within port 16. If plug 28 is removed from port 16, optical sensor 40 will not detect optical signal 42 emitted by transmitter 34. Thus, responsive to removal of plug 28, while security device 10 is armed, security sensor 15 will trigger an alarm. Second, for optical sensor 40 to receive optical signal 42, transmitter 34 must be energized to emit optical signal 42. Because transmitter 34 is driven by electric current supplied via electrical conductor 30 disposed within cable 24, cutting cable 24 or disconnecting cable 24 from pedestal 18 will deenergize transmitter 34. When optical transmitter 34 is deenergized, it cannot emit optical signal 42. If optical sensor 40 does not detect optical signal 42, security sensor 15 will trigger the alarm.

In the scheme discussed in the preceding paragraph, unilateral communication between transmitter 34 and optical sensor 40 provides an effective way for retention member 14 to independently monitor integrity of the following components of the security device 10: (1) connection between retention member 14 and tether cable 24, (2) integrity of tether cable 24, (3) integrity of connection between tether cable 24 and the power source, and (4) integrity of the electrical circuitry driving optical transmitter 34. Thus, if a thief either (1) disconnects tether cable 24 from retention member 14, (2) cuts tether cable 24, (3) removes cable 24 from pedestal 18, or (4) disconnects security device 10 from the power supply—e.g., by removing pedestal 18 from display counter 20, then optical sensor 40 will stop receiving optical signal 42, thereby causing security sensor 15 within retention member 14 to trigger the alarm.

Security device 10 achieves redundancy by enabling both security sensor 15 and pedestal 18 to independently monitor integrity of cable 24 and connection between plug 28 and port 16. Because security device 10 uses only one optical transmitter 34 to create and optical security loop, security device 10 obviates complex synchronization issues between two transceivers encountered in bidirectional communication systems. Security device 10 merely requires that optical transmitter 34 be configured to energize at predetermined time intervals to emit optical signal 42, which is then detected by optical sensor 40 within retention member 14, while optical reflection 46 of optical signal 42 within echo chamber 44 is detected by optical sensor 36—thus, providing redundancy.

In sharp contrast to security device 10, prior art security devices that rely on bidirectional communication between two transceivers (such as the one disclosed in the '274 Patent discussed above), require synchronization schemes to ensure that when, the first transceiver is speaking, the second transceiver is listening. Small drift in the synchronization of the two transceivers may cause the transceivers to talk over one another, which would cause the security device to fail. Security device 10, on the other hand, provides a comparable level of redundancy—however, because security device 10 uses unidirectional communication—the synchronization and reliability issues explained above are eliminated.

Figure 4:
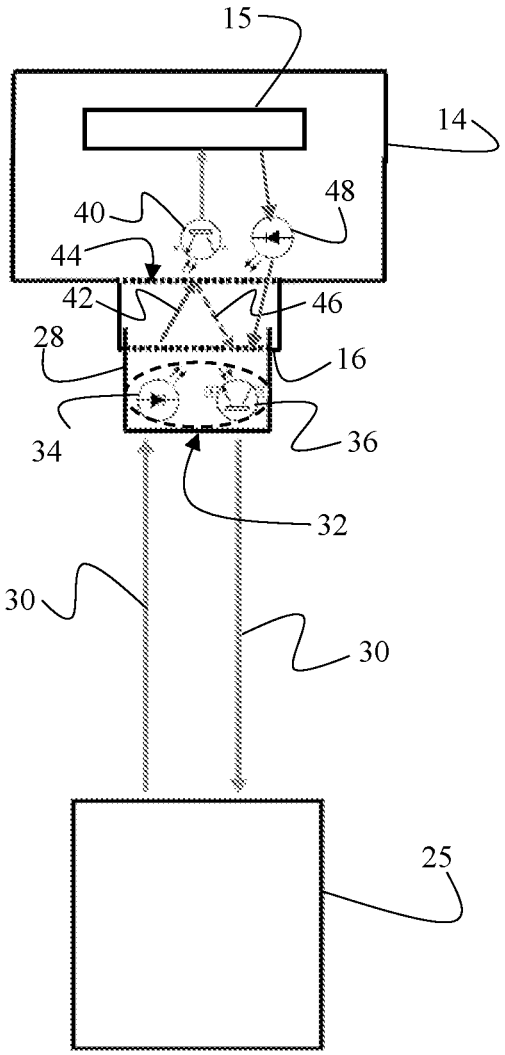
FIG. 4 is a diagram depicting an embodiment of the invention in which the security sensor has a transmitter being utilized to communicate payload data to the pedestal.

In yet another embodiment, depicted in FIG. 4, retention member 14 can be equipped with an optical transmitter 48 configured to communicate data about article of merchandise 12. Optical transmitter 48 does not participate in the security optical loop described above, and, instead, is used only to transmit payload data from retention member 14 to pedestal 18 via electrical conductors 30 within cable 24. In this embodiment, optical sensor 36 within cable 24 can be used to detect optical signals emitted by optical transmitter 48. Optical transmitter 48 and optical sensor 40 can belong to a single transceiver.

In contrast to optical transmitter 34, which is used to create a security optical loop, optical transmitter 48 is used solely to relay payload data from retention member 14 to pedestal 18. In this embodiment, retention member 14 may be operably connected to article of merchandise 12 and may be configured to communicate information pertaining to or generated by article of merchandise 12 to pedestal 18. Transmitter 38 transmits optical signals corresponding to the collected data into chamber 44. Optical sensor 36 receives those signals and relays them to security interface 25 within pedestal 18 via electrical conductors 30 within cable 24. The payload data can have a plurality of purposes: for example, analysis of data to determine frequency of customer interaction with article of merchandise 12.

One application of the payload data feature described above is depicted in FIGS. 5-6. In this embodiment, retention member 14 is equipped with an inductive charging coil 50. Inductive charging coil 50 is configured to wirelessly provide power to article of merchandise 12. In this embodiment, retention member 14 has electrical contacts 52, while pedestal 18 has complementary electrical contacts 54. When retention member 14 is resting on pedestal 18, electrical contacts 52 and 54 engage one another enabling electric current to flow from electrical contacts 54 to electrical contacts 52.

Figure 6:
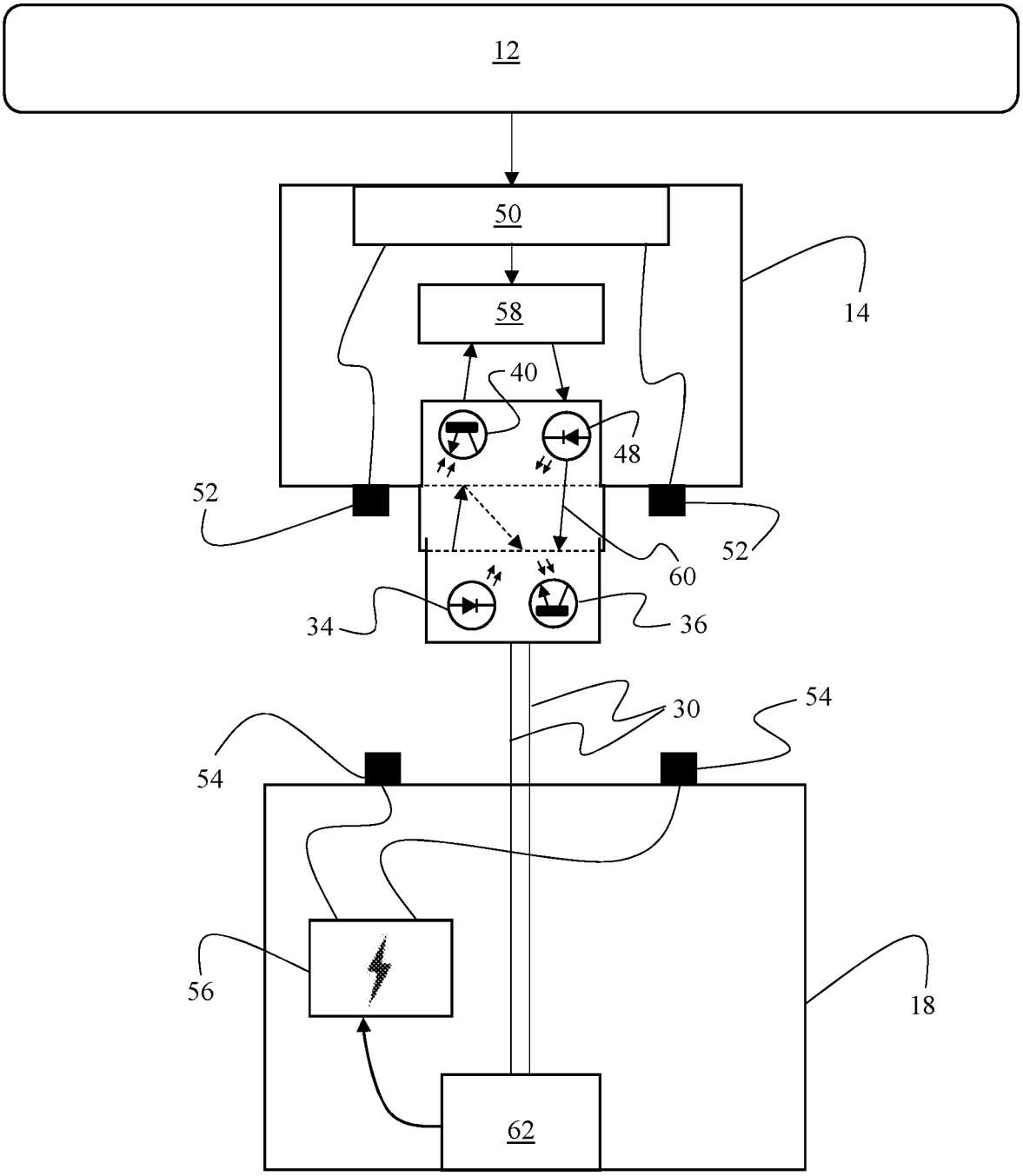
FIG. 6 is a diagram depicting an embodiment of the invention in which the security sensor has an inductive charging coil configured to wirelessly power the article of merchandise.

As depicted in FIG. 6, electrical contacts 52 are electrically connected to inductive charging coil 50. Electrical contacts 52 are configured to supply electrical power to inductive charging coil 50 when retention member 14 is resting on pedestal 18 and electrical contacts 52 engage electrical contacts 54. When in receipt of electrical power, inductive charging coil 50 is configured to wirelessly power article of merchandise 12.

FIG. 6 further depicts an adjustable voltage power supply 56. In the embodiment depicted in FIG. 6, adjustable voltage power supply 56 is housed within pedestal 18. Power supply 56 is electrically connected to electrical contacts 54 and is configured to provide electrical power thereto. Power supply 56 can adjust its output voltage and, therefore, the amount of electrical power supplied to inductive charging coil 50 via electrical contacts 52 and 54.

FIG. 6 further depicts that control unit 62 communicates with adjustable voltage power supply 56. Control unit 62 includes a microprocessor configured to issue commands to power supply 56, instructing power supply 56 to either set the output voltage to a predefined value or to increase the output voltage by a certain increment. In this manner, control unit 62 can control the amount of power supplied to inductive charging coil 50 and, consequently, to article of merchandise 12. It shall be noted that adjustable voltage power supply 56 and/or control unit 62 can be located outside pedestal 18, for example underneath the display counter or in a remote location.

Because different articles of merchandise 12 have different power requirements, it is desirable that the power output of inductive charging coil 50 can be adjusted to meet those requirements. For example, some smartphones do not require more than 5 Watts of power transferred from inductive charging coil 50, while other smartphone models are configured to be charged at a much higher rate using power transfer of 15 Watts or higher. The power output of inductive charging coil 50 is determined by the voltage output of adjustable voltage power supply 56.

In an embodiment depicted in FIG. 6, retention member 14 comprises a microprocessor 58, which is electrically connected to inductive charging coil 50. Initially, power supply 56 is configured to output a predefined minimum voltage, for example, 5 Volts. When article of merchandise 12 is placed onto inductive charging coil 50, microprocessor 58 monitors inductive charging coil 50 to determine whether article of merchandise 12 is requesting more power. Responsive to determining that article of merchandise 12 is requesting more electrical power than currently outputted by inductive charging coil 50, microprocessor 58 energizes optical transmitter 48 to transmit an optical signal 60. Optical signal 60 indicates that the power output should be increased.

Next, optical sensor 36 receives optical signal 60 and outputs a corresponding electrical signal carrying the payload data. In an embodiment, this electrical signal is delivered to control unit 62 via electrical conductors 30 disposed within cable 24. Responsive to receiving this payload data, control unit 62 triggers adjustable voltage power supply 56 to increase the output voltage thereof. The increase in the voltage output of power supply 56 results in increased electrical power delivered to inductive charging coil 50.

In an embodiment, the voltage output of power supply 56 is increased incrementally responsive to article of merchandise 12 requesting more power. When article of merchandise 12 stops requesting more power, the voltage output of power supply 56 will remain constant. In this manner, optical channel between optical transmitter 48 and optical sensor 36 is used to create a power-negotiation loop between article of merchandise 12 and inductive charging coil 50.

In an alternative embodiment, optical sensor 36 may be disposed within pedestal 18, rather than within the terminal connector of tether cable 24. In this embodiment, tether cable 24 can be eliminated—such that, optical transmitter 48 will communicate optical signals 60 to optical sensor 36 when retention member 14 is at rest on pedestal 18. Alternatively, when optical sensor 36 is disposed within pedestal 18, an optical conduit can be disposed within tether cable 24 to enable transmission of optical signal 60 from optical transmitter 48 to optical sensor 36 via tether cable 24.

Figure 5A:
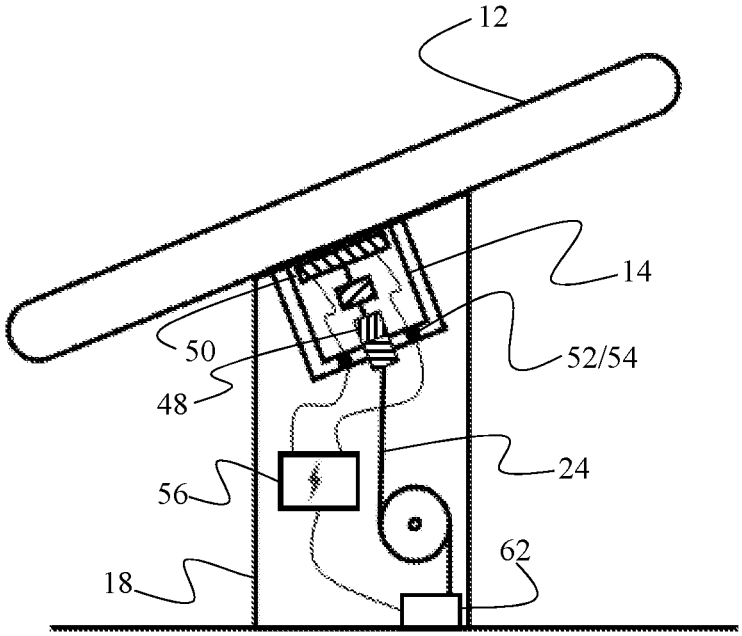
FIG. 5A is a schematic side view of an embodiment of the anti-theft device having a wireless chagrining feature, wherein the retention member is resting on the pedestal.
Figure 5B:
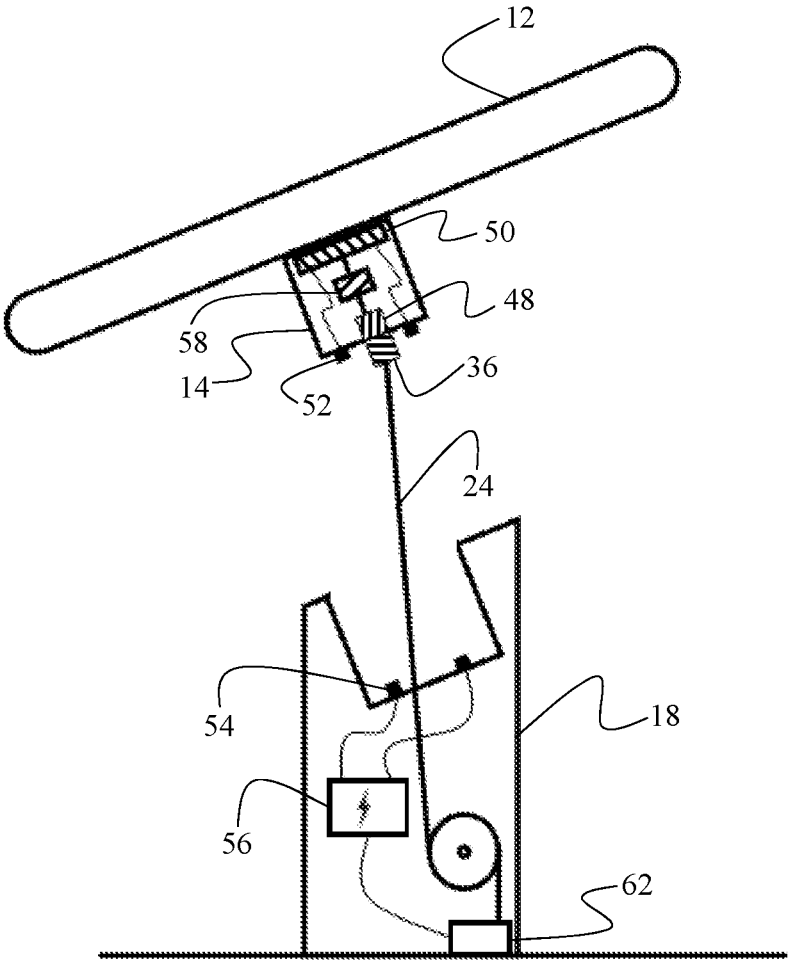
FIG. 5B is a schematic side view depicting an embodiment of the anti-theft device having a wireless chagrining feature, wherein the retention member is lifted from the pedestal.

In summary, in the embodiment depicted in FIGS. 5-6, an inductive charging coil 50 is located in retention member 14. Power is delivered from adjustable voltage power supply 56 to inductive charging coil 50 via mating electrical contacts 54 and 52, which are electrically connected with one another when retention member 14 is resting on pedestal 18. Initially, the voltage output of power supply 56 is set to a predetermined minimum level. If article of merchandise 12 requests more power, a corresponding command is transmitted as optical signal 60 from optical transmitter 48. Optical signal 60 is received by optical sensor 36, which can be housed within the connector of cable 24 or within pedestal 18. In response to receiving optical signal 60, optical sensor 36 outputs an electrical signal. This electrical signal is delivered to control unit 62 via electrical conductors 30. In response to receiving this electrical signal, control unit 62 sends a command to adjustable voltage power supply 56, triggering an incremental increase of the voltage output of power supply 56. The increased voltage output of power supply 56 increases the amount of electrical power delivered to inductive charging coil 50 and, consequently, increases the amount of power wirelessly delivered from inductive charging coil 50 to article of merchandise 12. This process of incremental electrical power increase continues until article of merchandise 12 stops requesting additional power. It shall be noted that the optical communication channel between optical transmitter 48 and optical sensor 36 can be independent of optical signals 42 and 46, which are used solely for security and alarm triggering purposes.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. An anti-theft device for securing an article of merchandise and wirelessly supplying power thereto, comprising:

a retention member configured to be attached to the article of merchandise, the retention member having a first electrical contact disposed on a surface thereof and an inductive charging coil housed within the retention member, wherein the inductive charging coil is electrically coupled to the first electrical contact, and wherein the inductive charging coil is configured to wireless supply power to the article of merchandise, wherein the inductive charging coil is configured to communicate with the article of merchandise to determine that electrical power wirelessly supplied from the inductive charging coil to the article of merchandise is to be increased;

a pedestal configured to removably support the retention member, the pedestal having a second electrical contact configured to form an electrical circuit with the first electrical contact of the retention member when the retention member is supported on the pedestal, thereby enabling electric current to flow from the second electrical contact to the inductive charging coil of the retention member;

a tether cable coupled to the retention member, wherein the tether cable has an electrical conductor configured to be electrically coupled to a control unit and to deliver electrical signals thereto;

a first optical transmitter housed within the retention member and a first optical sensor housed within a cable connector, wherein the first optical sensor is configured to receive a first optical signal emitted by the first optical transmitter when the cable connector is coupled to the retention member, wherein the first optical signal indicates a request to increase power supplied from the second electrical contact disposed on the pedestal to the first electrical contact disposed on retention member;

an adjustable voltage power supply in electrical communication with the control unit, wherein responsive to receiving a predefined electrical signal via the conductor disposed within the tether cable, the control unit triggers the adjustable voltage power supply to increase an output voltage thereof, thereby increasing electrical power delivered to the inductive charging coil disposed within the retention member via the electrical circuit formed between the first electrical contact disposed on the retention member and the second electrical contact disposed on the pedestal; and wherein increasing the output voltage of the adjustable voltage power supply causes the inductive charging coil disposed within the retention member to increase electrical power wirelessly delivered to the article of merchandise.

2. The anti-theft device of claim 1, further comprising a microprocessor disposed within the retention member, the microprocessor being in electrical communication with the inductive charging coil and the first optical transmitter, wherein the microprocessor is configured to energize the first optical transmitter to transmit the first optical signal responsive to the inductive charging coil detecting the article of merchandise requesting power increase.

3. The anti-theft device of claim 1, wherein the first optical transmitter is an infrared emitter.

4. The anti-theft device of claim 1, wherein the first optical sensor is a photo-transistor.

5. The anti-theft device of claim 1, wherein the first optical transmitter is configured to communicate payload data, different from the first optical signal, to the first optical sensor.

6. The anti-theft device of claim 1, further comprising a second optical transmitter disposed within the cable connector, the second optical transmitter being configured to emit an optical security signal, wherein the optical security signal is used to detect whether the tether cable has been cut or disconnected from the retention member.

7. The anti-theft device of claim 6, further comprising a second optical sensor disposed within the retention member, the second optical sensor being configured to receive the optical security signal emitted by the second optical transmitter, wherein failure of the second optical receiver to receive the optical security signal triggers an alarm.

8. The anti-theft device of claim 6, wherein the optical security signal creates a reflected optical signal within an optical chamber formed at an interface of the cable connector and the retention member, wherein failure of the first optical sensor within the cable connector to receive the reflected optical signal triggers an alarm.

9. The anti-theft device of claim 1, wherein the cable connector comprises a second optical transmitter and the retention member comprises a second optical sensor, the second optical transmitter configured to emit a second optical signal and the second optical sensor configured to receive the second optical signal, wherein the second optical signal acknowledges receipt of the first optical signal by the first optical sensor.

10. The anti-theft device of claim 1, wherein the anti-theft device does not use the first optical signal emitted by the first optical transmitter for detecting whether the tether cable has been cut or disconnected.

11. An anti-theft device for safeguarding an article of merchandise and wirelessly supplying power thereto, comprising:

a retention member configured to be attached to the article of merchandise, the retention member having a first electrical contact disposed on a surface thereof and an inductive charging coil housed within the retention member, wherein the inductive charging coil is electrically coupled to the first electrical contact, and wherein the inductive charging coil is configured to wireless supply power to the article of merchandise, wherein the inductive charging coil is configured to communicate with the article of merchandise to determine that electrical power wirelessly supplied from the inductive charging coil to the article of merchandise is to be increased;

a pedestal configured to removably support the retention member, the pedestal having a second electrical contact configured to form an electrical circuit with the first electrical contact of the retention member when the retention member is supported on the pedestal, thereby enabling electric current to flow from the second electrical contact to the inductive charging coil of the retention member;

a first optical transmitter housed within the retention member and a first optical sensor in electrical communication with a control unit, the first optical transmitter configured to emit a first optical signal responsive to the article of merchandise requesting a power increase and the first optical sensor configured to detect the first optical signal and, in response to detecting the first optical signal, configured to output an electrical signal, wherein the electrical signal output by the first electrical sensor is received by the control unit;

an adjustable voltage power supply in electrical communication with the control unit, wherein responsive to receiving the electrical signal, the control unit triggers the adjustable voltage power supply to increase an output voltage thereof, thereby increasing electrical power delivered to the inductive charging coil disposed within the retention member via the electrical circuit formed between the first electrical contact disposed on the retention member and the second electrical contact disposed on the pedestal;

wherein increasing the output voltage of the adjustable voltage power supply causes the inductive charging coil disposed within the retention member to increase electrical power wirelessly delivered to the article of merchandise.

12. The anti-theft device of claim 11, further comprising a tether cable configured to connect the retention member to the pedestal.

13. The anti-theft device of claim 11, further comprising a microprocessor disposed within the retention member, the microprocessor being in electrical communication with the inductive charging coil and the first optical transmitter, wherein the microprocessor is configured to energize the first optical transmitter to transmit the first optical signal responsive to the article of merchandise requesting the increased power.

14. The anti-theft device of claim 11, wherein the first optical transmitter is an infrared emitter.

15. The anti-theft device of claim 11, wherein the first optical sensor is a photo-transistor.

16. The anti-theft device of claim 11, wherein the first optical transmitter is configured to communicate payload data to the first optical sensor.

17. The anti-theft device of claim 12, further comprising a second optical transmitter configured to emit an optical security signal, wherein the optical security signal is used to detect whether the tether cable has been cut or disconnected from the retention member.

18. The anti-theft device of claim 11, further comprising a second optical sensor disposed within the retention member, the second optical sensor being configured to receive an optical security signal, wherein failure of the second optical receiver to receive the optical security signal triggers an alarm.

19. The anti-theft device of claim 11, further comprising a second optical transmitter configured to emit a second optical signal acknowledging that the first optical sensor received the first optical signal, wherein the retention member comprises a second optical sensor configured to receive the second optical signal.

20. The anti-theft device of claim 12, wherein the anti-theft device does not use the first optical signal emitted by the first optical transmitter for detecting whether the tether cable has been cut or disconnected.

* * * * *